US009984842B2

(12) United States Patent
Kawamura

(10) Patent No.: US 9,984,842 B2
(45) Date of Patent: May 29, 2018

(54) ELECTRONIC COMPONENT ASSEMBLY STRUCTURE AND ELECTRONIC COMPONENT

(71) Applicant: Yazaki Corporation, Tokyo (JP)

(72) Inventor: Yukihiro Kawamura, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days. days.

(21) Appl. No.: 14/870,700

(22) Filed: Sep. 30, 2015

(65) Prior Publication Data

US 2016/0020050 A1 Jan. 21, 2016

Related U.S. Application Data

(63) Continuation of application No. PCT/JP2014/059813, filed on Apr. 3, 2014.

(30) Foreign Application Priority Data

Apr. 12, 2013 (JP) ..... 2013-084228

(51) Int. Cl.
*H01R 12/00* (2006.01)
*H01H 45/14* (2006.01)
(Continued)

(52) U.S. Cl.
CPC ..... *H01H 45/14* (2013.01); *H01H 45/02* (2013.01); *H01H 50/047* (2013.01);
(Continued)

(58) Field of Classification Search
CPC ..... H01R 23/722; H01R 2201/26; H05K 7/1069; H05K 7/1023; H05K 7/026; H05K 7/1084
(Continued)

(56) References Cited

U.S. PATENT DOCUMENTS 4,504,102 A * 3/1985 Wakuluk ..... H01R 12/675 439/391
5,192,215 A * 3/1993 Grabbe ..... H01R 13/193 439/525
(Continued)

FOREIGN PATENT DOCUMENTS

JP 55-39679 Y1 3/1980
JP 59-46469 U 3/1984
(Continued)

OTHER PUBLICATIONS

International Search Report for PCT/JP2014/059813 dated Jun. 17, 2014.
(Continued)

*Primary Examiner* — Hien Vu
(74) *Attorney, Agent, or Firm* — Sughrue Mion, PLLC

(57) ABSTRACT

An electronic component including a component main body and a plurality of lead terminals is inserted and accommodated in a housing member, the lead terminals are brought into contact with a plurality of terminal fittings held in the housing member. The lead terminals are formed such that at least one of the number of lead terminals on each side surface before and after the reversing, a distance between the contact portion and the side surface of the component main body facing the contact portion, and a width dimension in a direction perpendicular to the extending direction of the contact portion differs, when the component main body is rotated at 180 degrees to reverse the positions of the pair of opposite side surfaces of the component main body. Accordingly, it is possible to prevent improper assembly of an electronic component.

2 Claims, 10 Drawing Sheets

(51) Int. Cl.

| | |
|---|---|
| ***H01R 13/642*** | (2006.01) |
| ***H01H 45/02*** | (2006.01) |
| ***H01H 50/04*** | (2006.01) |
| *H01R 13/422* | (2006.01) |
| *H01R 13/518* | (2006.01) |
| *H01H 50/14* | (2006.01) |

(52) U.S. Cl.
CPC ..... *H01R 13/642* (2013.01); *H01H 50/14* (2013.01); *H01H 2050/049* (2013.01); *H01R 13/4223* (2013.01); *H01R 13/518* (2013.01)

(58) Field of Classification Search
USPC ..... 439/68, 70, 76.2, 620.24, 698
See application file for complete search history.

(56) References Cited

U.S. PATENT DOCUMENTS

| | | | | |
|---|---|---|---|---|
| 6,270,361 | B1 * | 8/2001 | Onizuka | H01R 9/226 439/76.2 |
| 6,388,889 | B1 * | 5/2002 | Oka | B60R 16/0238 361/775 |
| 6,619,967 | B2 * | 9/2003 | Murakoshi | H05K 3/328 439/76.2 |
| 9,496,108 | B2 * | 11/2016 | Kawamura | H01H 50/048 |
| 2005/0221642 | A1 | 10/2005 | Saka | |
| 2012/0200282 | A1 * | 8/2012 | Togashi | H01F 17/04 323/311 |

FOREIGN PATENT DOCUMENTS

| | | | |
|---|---|---|---|
| JP | 63-85894 | U | 6/1988 |
| JP | 63-146939 | U | 9/1988 |
| JP | 11-225416 | A | 8/1999 |
| JP | 4424042 | B2 | 3/2010 |
| JP | 2010-221787 | A | 10/2010 |
| JP | 2011-40181 | A | 2/2011 |
| JP | 2011-081963 | A | 4/2011 |

OTHER PUBLICATIONS

Communication dated Oct. 31, 2016 from the State Intellectual Property Office of the P.R.C., in counterpart Chinese application No. 201480019843.4.
Communication dated Aug. 4, 2016, from the Japanese Patent Office in counterpart Japanese application No. 2013-084228.
Communication dated Oct. 12, 2016, from the Japanese Patent Office in counterpart Japanese application No. 2013-084228.
Communication dated Dec. 19, 2017 from the Germany Patent Office in counterpart German application No. 112014001930.5.

* cited by examiner

ELECTRONIC COMPONENT ASSEMBLY STRUCTURE AND ELECTRONIC COMPONENT

CROSS-REFERENCE TO RELATED APPLICATION

This application is a continuation application of International Application PCT/JP2014/059813, filed on Apr. 3, 2014, and designating the U.S., the entire contents of which are incorporated herein by reference.

BACKGROUND OF THE INVENTION

1. Field of the Invention

The present invention relates to an electronic component assembly structure and an electronic component, and more particularly, to an electronic component assembly structure provided to an electrical junction box which is mounted on a moving object such as an automobile.

2. Description of the Related Art

In general, a moving object such as an automobile is equipped with an electrical junction box in which an electronic component such as a relay is accommodated to control connection between a power supply device and an electric component (see Japanese Patent Application Laid-open No. 2010-221787).

FIG. 9 is a longitudinal-sectional view of a relay module according to the related art. As illustrated in FIG. 9, a relay 1 according to the related art includes a relay main body 2 formed in a rectangular parallelepiped shape and plural plate-like lead terminals 3 protruding in a straight line shape from one surface (bottom surface) of the relay main body 2. Such a type of relay is assembled into a resinous holding member 6, which holds terminal fittings 5 connected to electrical wires 4, to constitute a relay module. The relay module is assembled into an electrical junction box. Each terminal fitting 5 is provided with a spring portion 7 to which the lead terminal 3 is fitted. The relay 1 is held by the holding member 6 by inserting tips of the plural lead terminals 3 into the spring portions 7. In FIG. 9, the relay module according to the related art is basically illustrated in a longitudinal-sectional view but only the relay main body 2 is illustrated in a side view.

However, since such a type of relay module is assembled in a state in which the relay main body 2 is placed on an end surface (top surface) of the holding member 6, for example, the height dimension (in the up-down direction in FIG. 9) of the relay module increases.

Therefore, for example, like a relay 11 illustrated in FIG. 10, it can be considered that each lead terminal is bent and formed in an L shape. FIG. 10 is a side view illustrating an example of a relay according to the related art. Each lead terminal 12 includes a base end 14 protruding from a side surface (one of a pair of side surfaces located opposite to each other) of a relay main body 13 having a rectangular parallelepiped shape and a contact portion 15 extending from the base end 14 and drooping along the side surface of the relay main body 13 from which the base end 14 protrudes. According to this configuration, since the relay main body 13 can be accommodated in an opened box-like housing member (not illustrated) by inserting the relay 11 into the housing member in the arrow direction and fitting tips of the lead terminals 12 (contact portions 15) to the terminal fittings held in the housing member, it is possible to reduce the height dimension of the relay module.

In general, an electronic component including a relay electrically functions normally by connecting plural lead terminals to corresponding terminal fittings. Here, the plural lead terminals disposed in the relay are generally formed substantially in the same shape. Accordingly, when the lead terminals cannot be distinguished from each other, there is a possibility that the relay will be assembled into the housing member with an improper arrangement. Accordingly, in FIG. 9, it is possible to enhance discriminability, for example, by forming a mark (such as a figure or a pattern) on the relay main body 2 which an operator can easily see in assembling the relay into the housing member 6.

However, in the relay illustrated in FIG. 10, since plural lead terminals 12 are disposed along the side surfaces of the relay main body 13, there are a lot of restrictions on design in forming a figure as a mark on the relay main body 13. When a mark such as a figure is formed but the lead terminals 12 are erroneously arranged on the outside of the mark, the mark is not conspicuous. Accordingly, in such a type of relay, there is a possibility that improper assembly in which the relay is assembled into the housing member with an improper arrangement will occur.

SUMMARY OF THE INVENTION

An object of the present invention is to prevent improper assembly of an electronic component.

In order to achieve the above mentioned object, an electronic component assembly structure according to one aspect of the present invention includes an electronic component configured to include a component main body having a rectangular parallelepiped shape and a plurality of lead terminals; a housing member in which the electronic component is inserted and accommodated; and a plurality of terminal fittings configured to be held in the housing member and to which the lead terminals are fitted, respectively, wherein each of the lead terminals includes a contact portion drooping along one of opposite side surfaces of the component main body, and the lead terminals are disposed to face a pair of opposite side surfaces of the component main body, when the component main body is rotated at 180 degrees to reverse the positions of the pair of opposite side surfaces of the component main body, at least one of the number of lead terminals on each side surface before and after the reversing, and a distance between the contact portion and the side surface of the component main body facing the contact portion differs, or a width dimension in a direction perpendicular to an extending direction of the contact portion of the lead terminal disposed on one of the pair of opposite side surfaces is different from the width dimension of the lead terminal disposed on the other of the pair of opposite side surfaces, and the width dimensions of the lead terminals disposed on the same side surface are equal to each other, and the electronic component is inserted and accommodated in the housing member, the plurality of lead terminals come in contact with the plurality of terminal fittings, respectively, and the electronic component is assembled into the housing member.

In this way, in order to guarantee a favorable connection to the contact portions of the lead terminals, the terminal fittings held in the housing member accommodating an electronic component, are generally disposed at positions with which the contact portions can come into contact (for example, to which the contact portions can be fitted) and are formed to correspond to the sizes of the contact portions. Accordingly, when a pair of opposite side surfaces of the component main body is reversed and the number of lead terminals or the positions or width dimensions thereof are different, the lead terminal cannot be inserted into the terminal fittings in assembling the relay with an improper arrangement and it is thus possible to satisfactorily prevent improper assembly.

Further, an electronic component according to another aspect of the present invention includes a component main body having a rectangular parallelepiped shape; and a plurality of lead terminals configured to be disposed to face a pair of opposite side surfaces of the component main body, wherein each of the lead terminals includes a contact portion drooping along the corresponding opposite side surface of the component main body, and when the component main body is rotated at 180 degrees to reverse the positions of the pair of opposite side surfaces of the component main body, at least one of the number of lead terminals on each side surface before and after the reversing, and a distance between the contact portion and the side surface of the component main body facing the contact portion differs, or a width dimension in a direction perpendicular to an extending direction of the contact portion of the lead terminal disposed on one of the pair of opposite side surfaces is different from the width dimension of the lead terminal disposed on the other of the pair of opposite side surfaces, and the width dimensions of the lead terminals disposed on the same side surface are equal to each other.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an electronic component assembly structure according to the present invention will be described with reference to the accompanying drawings. In this embodiment, a relay module in which a relay is used as an electronic component and the relay is accommodated in a housing member will be described, but the electronic component assembly structure according to the present invention can be applied to electronic components other than the relay.

The use of the relay module according to this embodiment is not particularly limited, but a case can be considered in which the relay module is used for equipment or the like for controlling a connection state between a power supply device and an electric component in a moving object such as an automobile. Specifically, for example, it can be considered that the relay module is introduced into an electrical junction box (junction box) disposed between an electric component and a battery which are mounted on an automobile and is used as a relay module for controlling input and cutoff of power. Such a type of relay module may be integrally formed with the electrical junction box, but may be formed as an independent body.

Figure 1:
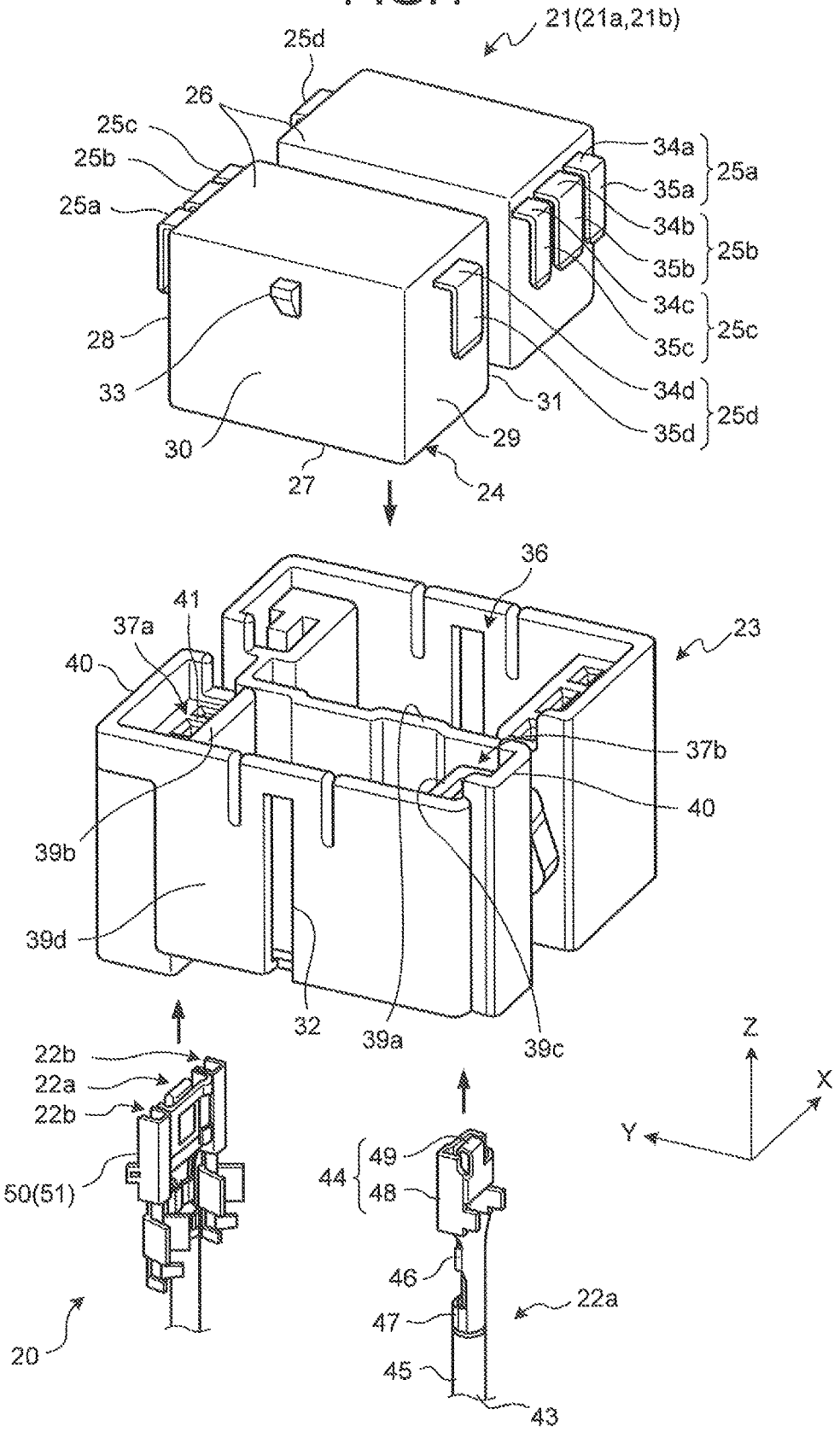
FIG. 1 is an assembly diagram of a relay module according to an embodiment of the present invention.
Figure 2:
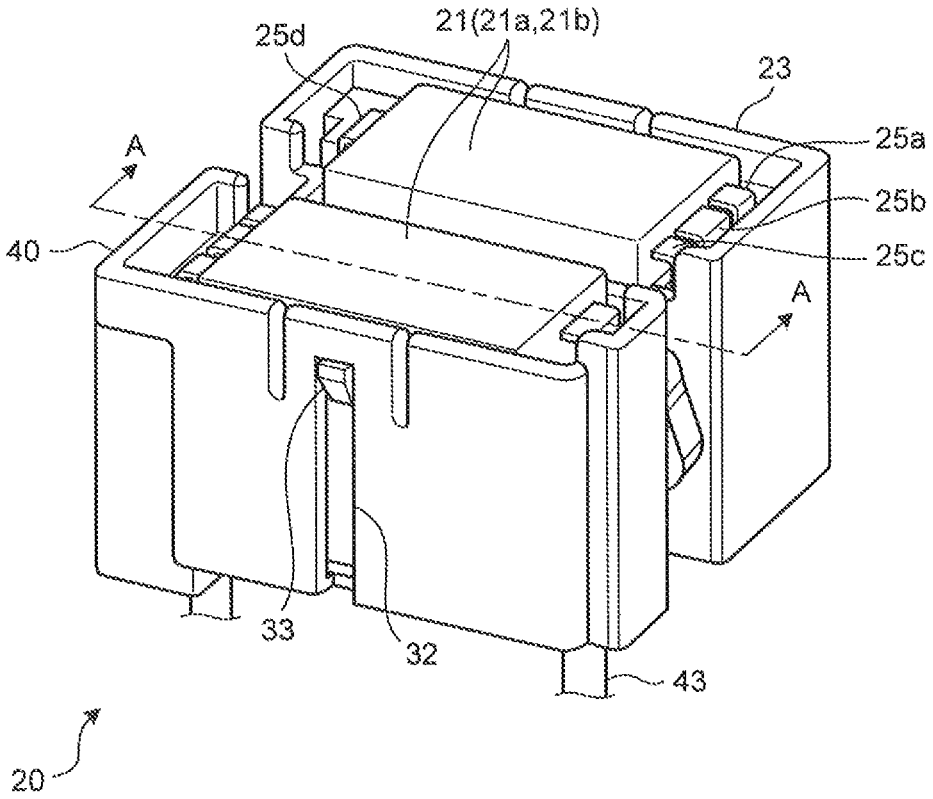
FIG. 2 is a diagram illustrating the entire configuration of the relay module illustrated in FIG. 1.
Figure 3:
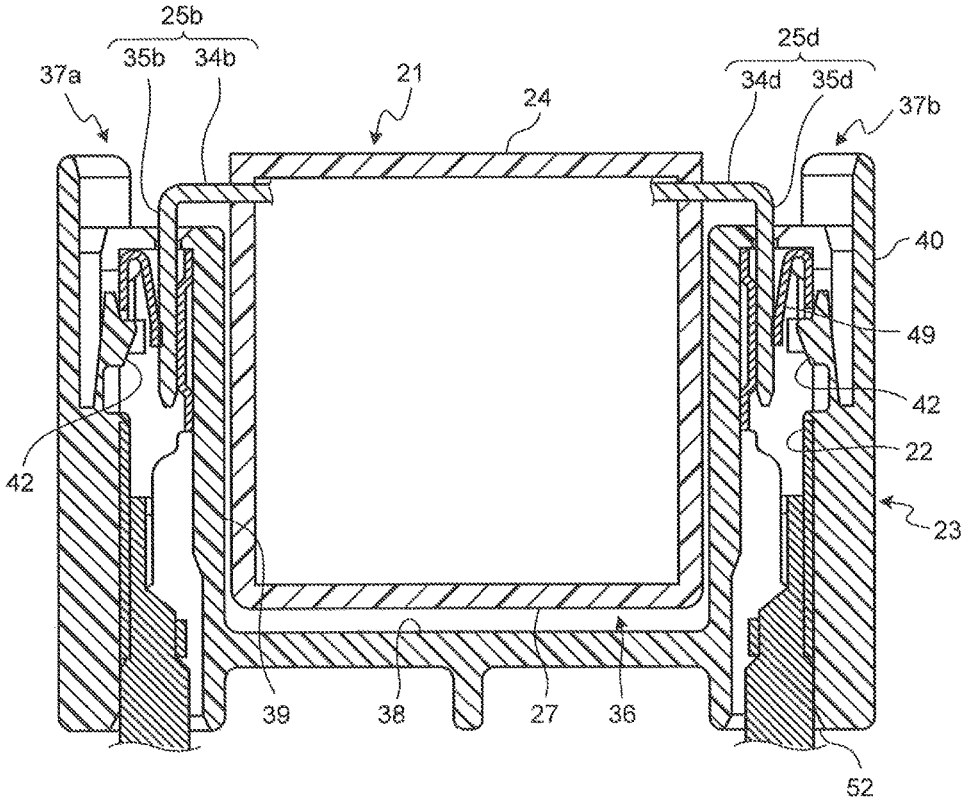
FIG. 3 is a longitudinal-sectional view taken along arrow A-A of FIG. 2.
Figure 6:
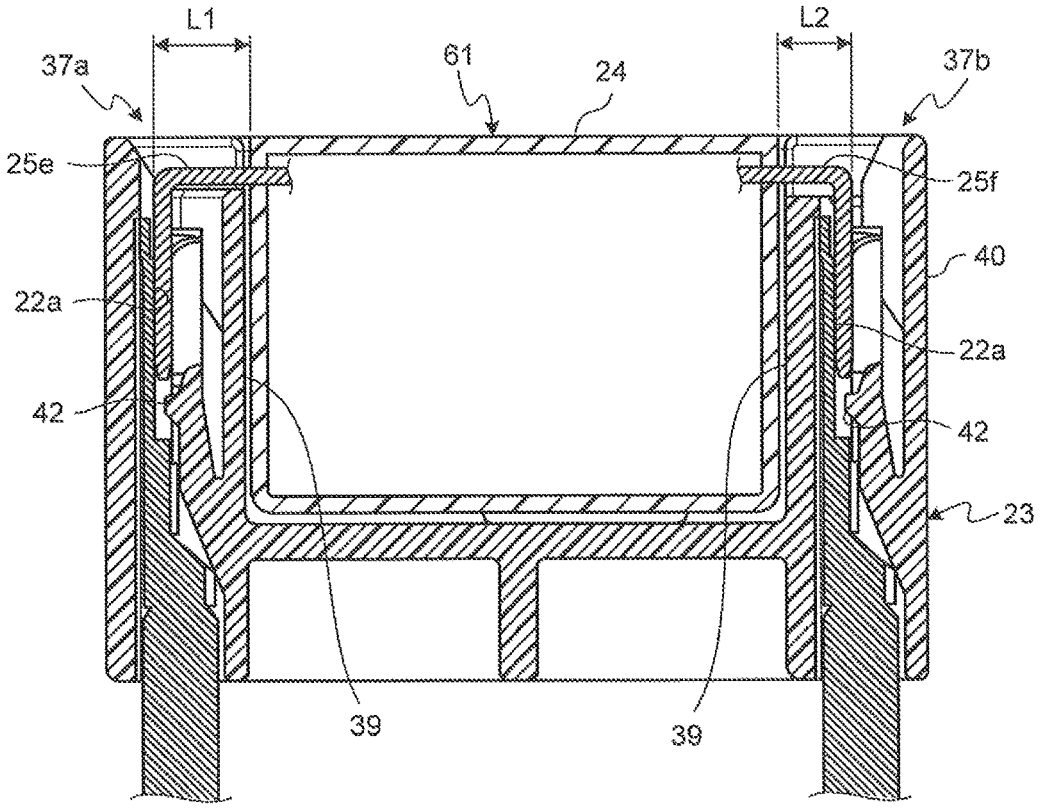
FIG. 6 is a longitudinal-sectional view of a relay module into which the relay illustrated in FIG. 5 is assembled.

FIG. 1 is an assembly diagram of a relay module 20 according to an embodiment. FIG. 2 is a diagram illustrating the entire configuration of the relay module 20 illustrated in FIG. 1. FIG. 3 is a cross-sectional view taken along arrow A-A of FIG. 2. In the following description, a direction indicated by arrow X in FIG. 1 is defined as a front-back direction, a direction indicated by arrow Y is defined as a right-left direction, and a direction indicated by arrow Z is defined as an up-down direction (hereinafter, the same applies to FIG. 2). However, the up-down direction, the right-left direction, and the front-back direction may not match the respective directions in a state in which the relay module 20 is actually mounted on a moving object. In FIGS. 3 and 6, various components accommodated in a relay main body 24 are not illustrated.

As illustrated in FIG. 1, the relay module 20 according to this embodiment has a configuration in which a relay 21, terminal fittings 22, and a housing member 23 are mutually assembled. In this embodiment, it is assumed that one relay module 20 includes two relays 21*a* and 21*b*. However, the number of relays constituting a relay module is not limited to two and the relay module may include only one relay or may include three or more relays. When the relay module includes plural relays, relays 21 having the configuration illustrated in FIG. 1 may be employed or relays having configurations (for example, FIG. 7) other than the configuration illustrated in FIG. 1 may be mixed.

Each relay 21 includes the relay main body 24 which is a component main body having a rectangular parallelepiped shape and which is formed of a resin or the like and four plate-like lead terminals 25*a* to 25*d* which protrude from the relay main body 24. The relay main body 24 is a hollow box-like container and accommodates an electronic component (not illustrated) therein. The relays 21*a* and 21*b* have the same configuration but the right and left sides thereof are reversed.

The relay main body 24 has a top surface 26 located above, a bottom surface 27 located below, a left side surface 28 and a right side surface 29 facing each other in the right-left direction, and a front surface 30 and a back surface 31 facing each other in the front-back direction. The relay main body 24 has a substantially rectangular parallelepiped shape which is long in the right-left direction, and four surfaces of the left side surface 28, the right side surface 29, the front surface 30, and the back surface 31 are set as side surfaces. The front surface 30 is provided with a locking protrusion 33 which engages with a penetration groove 32 formed in the housing member 23. The relay main body 24 according to this embodiment is formed in a rectangular parallelepiped shape, but may be formed in a square parallelepiped shape.

Each of the lead terminals 25*a* to 25*d* includes a plate-like base end 34 (34*a* to 34*d*) protruding from one of a pair of opposite side surfaces of the relay main body 24 and a plate-like contact portion 35 (35*a* to 35*d*) extending from the base end 34 and drooping along one of the opposite side surfaces of the relay main body 24. The lead terminals 25*a* to 25*c* among the lead terminals 25 include base ends 34*a* to 34*c* perpendicularly protruding from the left side surface 28 of the relay main body 24 with a gap therebetween in the width direction (the front-back direction) of the relay main body 24 and contact portions 35*a* to 35*c* drooping along the left side surface 28 from the base ends 34*a* to 34*c* with a predetermined gap from the left side surface 28 of the relay main body 24. On the other hand, the lead terminal 25*d* includes a base end 34*d* perpendicularly protruding from the right side surface 29 of the relay main body 24 and a contact portion 35*d* drooping from the base end 34*d* with a predetermined gap from the right side surface 29 of the relay main body 24.

The base ends 34*a* to 34*d* protrude in parallel to the top surface 26 or the bottom surface 27, and the protruding position is set to the same height position below the top surface. On the other hand, the contact portions 35*a* to 35*d* extend in parallel with the opposite left side surface 28 of the relay main body 24 and the distances thereof from the opposite left side surface 28 are set to the same. In the contact portions 35*a* to 35*d*, the height positions of the tips (lower ends) thereof are set to the same height position above the bottom surface 27 of the relay main body 24. The widths in the front-back direction of the base ends 34*a* and 34*c* and the contact portions 35*a* and 35*c* of the lead terminals 25*a* and 25*c* are set to the same magnitude, and the widths in the front-back direction of the base ends 34*b* and 34*d* and the contact portions 35*b* and 35*d* of the lead terminals 25*b* and 25*d* are set to the same magnitude. The widths in the front-back direction of the base ends 34*b* and 34*d* and the contact portions 35*b* and 35*d* of the lead terminals 25*b* and 25*d* are set to be greater than the widths in the front-back direction of the base ends 34*a* and 34*c* and the contact portions 35*a* and 35*c* of the lead terminals 25*a* and 25*c*.

The housing member 23 is a resinous casing for accommodating and holding the relay 21 and the terminal fittings 22 and includes a first housing chamber 36 that guides and accommodates the relay main body 24 therein and a second housing chamber 37 (37*a* and 37*b*) that accommodates and holds the terminal fittings 22 therein. In this embodiment, the housing member 23 is treated as a single member independent of an electrical junction box not illustrated. However, the housing member 23 may be formed as a part of a casing which is formed in the electrical junction box and may be formed as a unified main body with the electrical junction box.

As illustrated in FIG. 1, two first housing chambers 36 are formed in the housing member 23 according to this embodiment, and two second housing chambers 37*a* and 37*b* are arranged with each first housing chamber 36 interposed therebetween. The lead terminals 25*a* to 25*c* are accommodated in the second housing chamber 37*a*, the lead terminal 25*d* is accommodated in the second housing chamber 37*b*, and the terminal fittings 22 are held at predetermined positions to correspond to the lead terminals 25 inserted into the second housing chambers 37*a* and 37*b*.

As illustrated in FIG. 3, the first housing chamber 36 is surrounded with a bottom wall 38 and wall portions 39 rising upright from the bottom wall 38 to form a concave space of which the top is opened to the outside. The wall portions 39 rise upright from the bottom wall 38 so as to surround the side surfaces (the left side surface 28, the right side surface 29, the front surface 30, and the back surface 31) of the relay main body 24 from four directions and guide and accommodate the relay main body 24 in the first housing chamber 36. The first housing chamber 36 is formed in a rectangular parallelepiped shape which is slightly larger than the relay main body 24, smoothly accommodates the relay main body 24 guided by the wall portions 39 therein, and holds the posture of the relay main body 24 by causing four side surfaces of the accommodated relay main body 24 to interfere with the wall portions 39.

As illustrated in FIG. 1, a penetration groove 32 directing the first housing chamber 36 to the outside of the housing member 23 is formed in a wall portion 39*d* (the wall portion facing the front surface 30 of the relay main body 24) other than a wall portion 39*a* partitioning the neighboring first housing chambers 36 and wall portions 39*b* and 39*c* as partition walls from the second housing chambers 37 among the four wall portions 39 (39*a* to 39*d*) forming the first housing chamber 36 so as to extend in the height direction of the wall portions 39. The penetration groove 32 is configured to lock a locking protrusion 33 of the relay main body 24 when the relay main body 24 is accommodated in the first housing chamber 36.

The second housing chambers 37*a* and 37*b* are disposed outside the wall portions 39*b* and 39*c* of the first housing chamber 36, that is, on the opposite sides of the first housing chamber 36 with the wall portions 39*b* and 39*c* interposed therebetween, and are surrounded with a rectangular tubular frame formed by the wall portions 39*b* and 39*c* and a frame portion 40 of the housing member 23 to form a rectangular parallelepiped space of which the top and the bottom are opened to the outside. In the second housing chamber 37*a*, at least the vicinity of an opening into which lead terminals 25 are inserted is partitioned by a partition wall 41 formed over the wall portion 39*b* and the frame portion 40. The second housing chambers 37*a* and 37*b* are provided with lances 42 (locking pieces) at positions facing the terminal fittings 22 as illustrated in FIG. 3. Each lance 42 serves to hold the corresponding terminal fitting 22 in the second housing chamber 37, is integrally molded to extend in a cantilever shape from the frame portion 40 to the second housing chamber 37 so as to be elastically deformable.

The terminal fitting 22 is an interface member that is connected to a terminal portion of an electrical wire 43 so as to electrically connect the electrical wire 43 to the relay 21. As illustrated in FIG. 1, each terminal fitting 22 includes a first terminal fitting 22*a* and a second terminal fitting 22*b*. The terminal fittings 22*a* and 22*b* are formed by machining a conductive metal sheet.

The first terminal fitting 22*a* serves to have the contact portions 35*b* and 35*d* fitted thereto and includes a female fitting portion 44 which supports the contact portion 35, a pair of core clamping pieces 46 which caulks a core wire exposed by peeling an insulating coating 45 of the terminal portion of the electrical wire 43, and a pair of external clamping pieces 47 which caulks a tip of the insulating coating 45 of the electrical wire 43. The fitting portion 44 includes a tubular portion 48 having a rectangular tubular shape and having a space into which the contact portions 35*b* and 35*d* are inserted and a spring portion 49 which is formed by folding a plate-like tongue portion connected to a side plate forming the tubular portion 48 from the vicinity of the insertion hole of the tubular portion 48 into the space in a mountain shape. The contact portions 35*b* and 35*d* are supported by the fitting portion 44 by pressing the contact portions 35*b* and 35*d* inserted into the space of the tubular portion 48 against another side plate facing the side plate with an elastic force of the spring portion 49.

The second terminal fitting 22*b* serves to have the contact portions 35*a* and 35*c* fitted thereto and the structure for supporting the contact portions 35 is basically the same as the first terminal fitting 22*a*. Accordingly, a fitting portion 50 corresponding to the fitting portion 44 of the first terminal fitting 22*a* will be described below. The fitting portion 50 includes a tubular portion 51 having a space into which the contact portions 35*a* and 35*c* are inserted and a spring portion (not illustrated) disposed in the tubular portion 51. The tubular portion 51 is formed to have a width smaller than that of the fitting portion 44 of the first terminal fitting 22*a*. That is, the fitting portion 50 supports the contact portions 35*a* and 35*c* by pressing the contact portions 35*a* and 35*c* inserted into the tubular portion 51 in a predetermined direction using the spring portion. Both the terminal fittings 22*a* and 22*b* have a well-known terminal structure, and are not particularly limited as long as they can support the contact portion 35. For example, a terminal fitting called a fastening type may be employed.

In this embodiment, as illustrated in FIG. 1, the second terminal fittings 22*b* are disposed on both sides of the first terminal fitting 22*a* and these terminal fittings are accommodated in the second housing chamber 37*a*. The first terminal fitting 22*a* is accommodated in the second housing chamber 37*b*. The terminal fittings 22*a* and 22*b* are supported in the second housing chamber 37 by the lances 42.

Each lance 42 forms a so-called spring mechanism, serves to press the lower edge of the spring portion 49 of the terminal fitting 22 with a restoration force from elastic deformation and to lock the lower edge, achieves fixation of the terminal fitting 22 to the second housing chamber 37, and holds the terminal fitting 22 in the second housing chamber 37. In this embodiment, the right and left lances 42 are arranged to be symmetric as illustrated in FIG. 3, but the right and left lances 42 may be disposed to extend in the same direction, for example, one lance 42 may extend from the frame portion 40 and the other lance 42 may extend from the wall portion 39.

For example, in order to accommodate the first terminal fitting 22*a* in the second housing chamber 37*b* and to hold the first terminal fitting 22*a* using the lances 42, the first terminal fitting 22*a* is inserted from an opening 52 (FIG. 3) on the bottom of the second housing chamber 37*b*. Then, the first terminal fitting 22*a* is inserted into the second housing chamber 37*b* until the tip (fitting portion 44) thereof comes in contact with the lance 42. When an upward force (insertion force) is applied to the first terminal fitting 22*a* so as to further insert the first terminal fitting 22*a* into the second housing chamber 37*b* in this state, the lance 42 is pressed by the first terminal fitting 22*a* and is elastically deformed to approach the frame portion 40. When an insertion force is applied to the first terminal fitting 22*a* against the restoration force from elastic deformation, the first terminal fitting 22*a* moves upward in a state in which the lance 42 comes in sliding contact with the fitting portion 44. When the first terminal fitting 22*a* moves and the lance 42 relatively reaches the lower edge of the spring portion 49 along the fitting portion 44, the lance 42 is elastically deformed and engages with the lower edge of the spring portion 49. By causing the lance 42 to engage with the first terminal fitting 22*a* in this way, the first terminal fitting 22*a* is locked to the lance 42. Accordingly, it is possible to prevent the first terminal fitting 22*a* from getting out of the second housing chamber 37*b*. That is, the first terminal fitting 22*a* is held in the second housing chamber 37*b*.

On the other hand, in this embodiment, the position in the up-down direction of the relay 21 in a state in which the relay 21 is accommodated in the housing member 23, that is, when the contact portions 35 of the lead terminals 25 are fitted to the spring portions of the terminal fittings 22, is set to a predetermined height position such that the top surface 26 of the relay main body 24 does not protrude upward from the top of the housing member 23 as illustrated in FIGS. 2 and 3. Here, the height position of the relay main body 24 can be determined depending on the positions at which the contact portions 35 of the lead terminals 25 are fitted to the spring portions 49 of the first terminal fittings 22*a* (which include the spring portions of the second terminal fittings 22*b*). That is, each terminal fitting 22 is held in the second housing chamber 37 at the height position at which the spring portion holding the contact portion 35 of the lead terminal 25 faces the side surface of the relay main body 24 accommodated in the first housing chamber 36 with the wall portion 39 interposed therebetween. For example, the top end face of the wall portion 39 is disposed at a predetermined height position below the top end surface of the housing member 23 so as not to contact with the base end 34 of the lead terminal 25 when the contact portion 35 of the lead terminal 25 is fitted to the spring portion of the terminal fitting 22, and the bottom wall 38 is disposed at a predetermined height position not coming in contact with the bottom surface 27 of the relay main body 24. Accordingly, except for the portions in which the contact portions 35 of the lead terminals 25 are fitted to the spring portions of the terminal fittings 22, the relay 21 is held in the housing member 23 without interfering with the bottom wall 38 or the top end face of the wall portion 39 in the height direction of the housing member 23. Accordingly, it is possible to satisfactorily bring the lead terminals 25 into contact with the terminal fittings 22 and thus to stabilize a holding force of the relay 21 in the housing member 23.

In assembling the relay 21 into the housing member 23 in this embodiment, the relay main body 24 is guided along the wall portion 39 and is inserted into the first housing chamber 36. When the vicinity of the lower end of the relay main body 24 is accommodated in the first housing chamber 36, the tips (lower ends) of the contact portions 35 of the lead terminals 25 are positioned to face the fitting portions above the terminal fittings 22. When the relay main body 24 is inserted to the vicinity of the bottom wall 38 of the first housing chamber 36 in a state in which the contact portions 35 are positioned in this way, the contact portions 35 are inserted into the tubular portions 48 (51) of the fitting portions and the contact portions 35 are supported (fitted) with the pressing force of the spring portions 49. In the relay module 20 assembled in this way, as illustrated in FIGS. 2 and 3, the relay 21 is held in the housing member 23 and the relay 21 is electrically connected to the electrical wire 43 via the terminal fittings 22.

Figure 4:
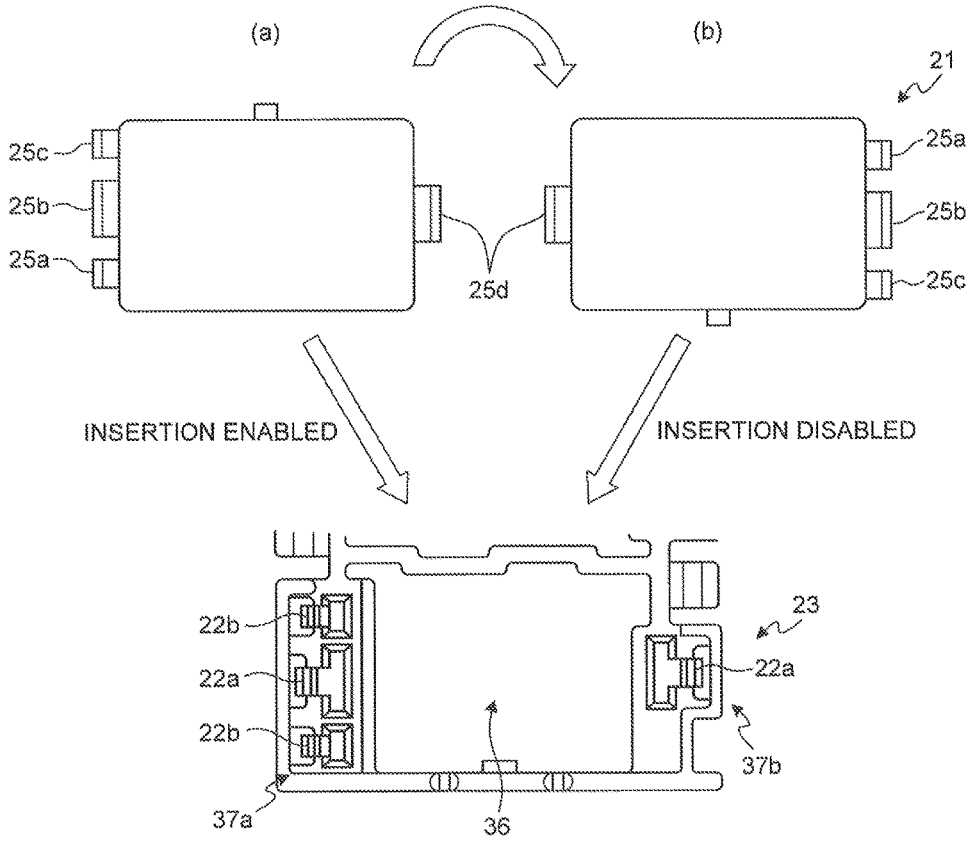
FIG. 4 is a plan view illustrating an operation of assembling a relay.

As illustrated in FIG. 4, the direction of the relay 21 which is assembled into the housing member 23 in which the second housing chamber 37*a* is disposed on the left side of the first housing chamber 36 will be described below. FIG. 4 is a plan view illustrating an operation of assembling the relay when the housing member 23 and the relay 21 are viewed from the upper side. Only the relay 21 in which the lead terminals 25*a* to 25*c* are disposed on the left side of the relay main body 24 like Arrangement (a) can be assembled into the housing member 23, and the relay 21 in which the lead terminals 25*a* to 25*c* are disposed on the right side of the relay main body 24 like Arrangement (b) cannot be assembled into the housing member 23.

That is, in the relay 21 according to this embodiment, when the relay main body 24 is rotated at 180 degrees to reverse the arrangement from Arrangement (a) to Arrangement (b) and a pair of opposite side surfaces 28 and 29 of the relay main body 24 is reversed, the numbers of lead terminals 25 on the side surfaces before and after the reversing differ. Accordingly, the relay 21 after the reversing cannot be assembled into the housing member 23 corresponding to the arrangement of the relay 21 before the reversing and it is thus possible to prevent improper assembly in which the relay 21 is assembled into the housing member 23 with an improper arrangement.

In the relay 21 according to this embodiment, three lead terminals 25 are disposed on one side surface (the left side surface 28) among a pair of opposite side surfaces of the relay main body 24 and one lead terminal 25 is disposed on the other side surface (the right side surface 29), but the combination of the numbers of lead terminals 25 is not limited to this example. The numbers of lead terminals 25 disposed on the side surfaces only have to be different from each other.

Another embodiment of the electronic component assembly structure according to the present invention will be described below. Since this embodiment basically has the same configuration as the above-mentioned embodiment, only characterized configurations will be described and the configurations common to the above-mentioned embodiment will not be described.

Figure 5:
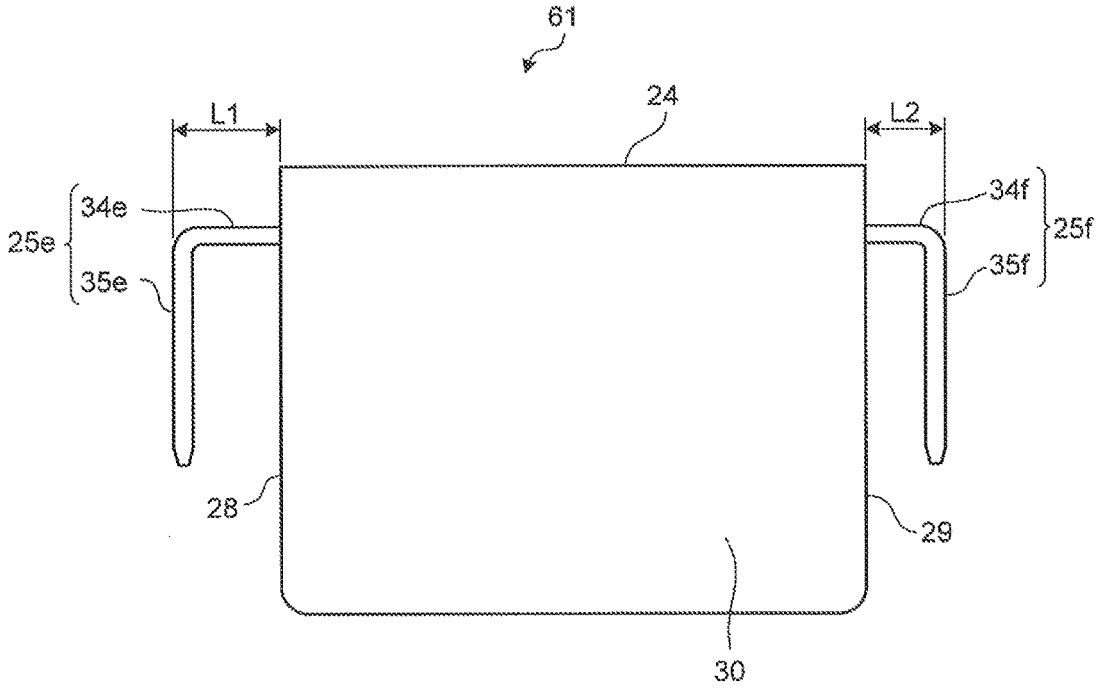
FIG. 5 is a side view of a relay according to another embodiment.

FIG. 5 is a side view of a relay according to another embodiment and FIG. 6 is a longitudinal-sectional view of a relay module into which the relay illustrated in FIG. 5 is assembled. In FIG. 6, it is assumed that the first terminal fittings 22*a* are held in both the second housing chambers 37*a* and 37*b* of the housing member 23. In this embodiment, lead terminals 25*e* and 25*f* disposed on a pair of opposite side surfaces 28 and 29 of the relay main body 24 are exemplified, but the shape or the number of other lead terminals disposed on the side surfaces 28 and 29 is not particularly limited. The pair of lead terminals 25*e* and 25*f* is disposed along a plane parallel to the front surface 30 of the relay main body 24 as illustrated in FIG. 5.

As illustrated in FIG. 5, in a relay 61 according to this embodiment, lengths of base ends 34*e* and 34*f* of the lead terminals 25*e* and 25*f* (lengths by which the base ends protrude from the side surfaces of the relay main body 24) are different from each other and thus distances between contact portions 35*e* and 35*f* of the lead terminals 25*e* and 25*f* and the side surfaces of the relay main body 24 are also different from each other. FIG. 5 illustrates an example in which the length L1 of the base end 34*e* of the lead terminal 25*e* disposed on the left side surface 28 is set to be larger than the length L2 of the base end 34*f* of the lead terminal 25*f* disposed on the right side surface 29.

In the housing member 23 in which the relay 61 having the above-mentioned configuration is accommodated, the holding positions of the first terminal fittings 22*a* are set to correspond to the lengths L1 and L2 of the base ends 34*e* and 34*f* of the lead terminals 25*e* and 25*f*. In the example illustrated in FIG. 6, the first terminal fittings 22*a* held in the second housing chambers 37*a* and 37*b* are disposed such that all the spring portions 49 are located on one side (on the right side) to press the lead terminals 25 toward the other side (the left side), and a lance 42 is disposed on one side of each first terminal fitting 22*a* (outside the spring portion 49). Regarding the thicknesses of the wall portions 39 partitioning the first housing chamber 36 and the second housing chambers 37, the wall portion 39 (on the right side) facing the second housing chamber 37*b* is set to be thicker than the wall portion 39 (on the left side) facing the second housing chamber 37*a*. In this embodiment, the relay 61 can be accommodated by biasing the holding positions of the right and left first terminal fittings 22*a* to the left side with respect to the first housing chamber 36 in this way.

According to this embodiment, the relay 61 can be accommodated in the housing member 23 having the arrangement illustrated in FIG. 6 by disposing the lead terminal 25*e* on the left side of the relay main body 24 and disposing the lead terminal 25*f* on the right side of the relay main body 24 as illustrated in FIG. 5. Here, when the relay 61 in the state illustrated in FIG. 5 is rotated and reversed at 180 degrees and a pair of opposite side surfaces 28 and 29 of the relay main body 24 is reversed, the length of the base ends 34 of the lead terminals 25 protruding from the side surfaces differs before and after the reversing. Accordingly, even when it is tried to assemble the relay 61 after the reversing into the housing member 23 (FIG. 6) having the arrangement corresponding to the arrangement of the relay 61 before the reversing, the positions of the lead terminals 25 and the terminal fittings 22 do not match each other and thus the assembly is disabled. The same result is produced even when at least the lengths of the base ends 34 of the pair of opposite lead terminals 25*e* and 25*f* are different from each other as illustrated in FIG. 5 but the numbers or shapes of other lead terminals 25 disposed on the side surfaces 28 and 29 are equal to each other. Accordingly, by employing the relay module according to this embodiment, it is possible to prevent improper assembly in which the relay 61 is assembled into the housing member 23 with an improper arrangement.

Figure 7:
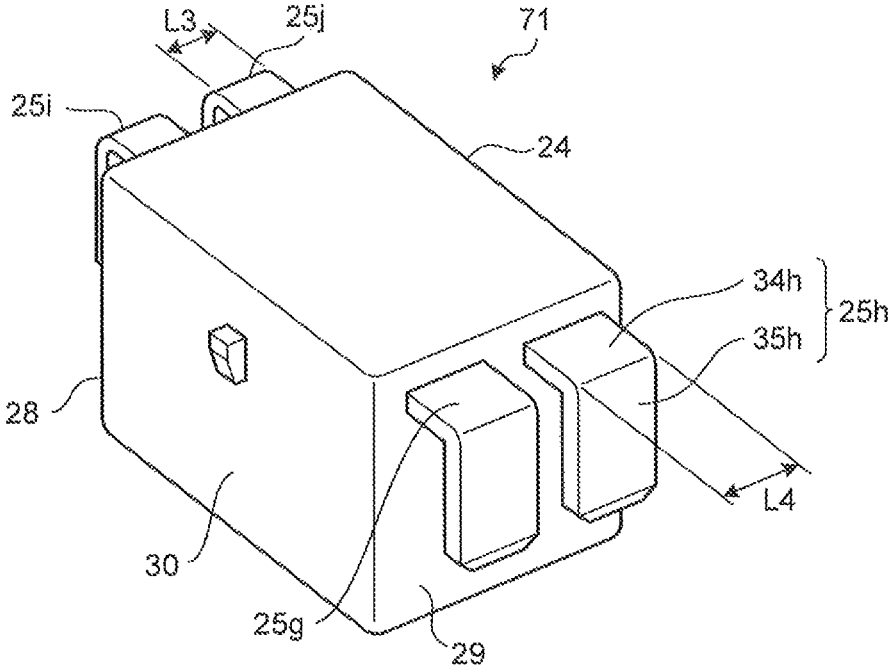
FIG. 7 is a perspective view of a relay according to another embodiment.

Another embodiment of the relay will be described below. FIG. 7 is a perspective view illustrating an appearance of a relay according to another embodiment. In a relay 71 according to this embodiment, among a pair of opposite side surfaces 28 and 29 of the relay main body 24, the width in the front-back direction of the lead terminals 25 disposed on one side surface is different from the width in the front-back direction of the lead terminals 25 disposed on the other side surface. Each of the side surfaces 28 and 29 is provided with two lead terminals 25, but the lead terminals 25 disposed on the same side surface are set to have the same width dimension in the front-back direction. In FIG. 7, the width dimensions in the front-back direction of lead terminals 25*i* and 25*j* disposed on the left side surface 28 are set to L3 and the width dimensions in the front-back direction of lead terminals 25*g* and 25*h* disposed on the right side surface 29 are set to L4 which is greater than L3.

In the housing member 23 in which the relay 71 having the above-mentioned configuration is accommodated, the terminal fittings 22 corresponding to the width dimensions of the lead terminals 25 are disposed at predetermined positions. A cross-section of the housing member 23 can be described, for example, using FIG. 3. Here, the terminal fittings 22 having a relatively small width dimension in the front-back direction are held in the second housing chamber 37*a* to correspond to the width dimension L3 of the lead terminals 25*i* and 25*j*, and terminal fittings 22 having a relatively large width dimension in the front-back direction are held in the second housing chamber 37*b* to correspond to the width dimension L4 of the lead terminals 25*g* and 25*h*.

According to this embodiment, when the relay 71 in the state illustrated in FIG. 7 is rotated and reversed at 180 degrees and a pair of opposite side surfaces 28 and 29 of the relay main body 24 is reversed, the width dimension in the front-back direction of the lead terminals 25 protruding from the side surfaces differs before and after the reversing. Accordingly, even when it is tried to assemble the relay 71 after the reversing into the housing member 23 having the arrangement corresponding to the arrangement of the relay 71 before the reversing, the width dimensions in the front-back direction of the lead terminals 25 and the terminal fittings 22 do not match each other and thus the assembly is disabled. The same result is produced even when at least the width dimensions in the front-back direction of a pair of lead terminals 25*i* and 25*g* (or lead terminals 25*j* and 25*h*) located on the opposite sides are different from each other as illustrated in FIG. 7 but the numbers or shapes of other lead terminals 25 disposed on the side surfaces 28 and 29 are equal to each other. Accordingly, by employing the relay module according to this embodiment, it is possible to prevent improper assembly in which the relay 71 is assembled into the housing member 23 with an improper arrangement.

In this embodiment, the base ends 34 and the contact portions 35 of the lead terminals 25 have the same width dimension. However, when a pair of side surfaces 28 and 29 located on the opposite sides of the relay main body 24 is reversed, the width dimensions in the front-back direction of at least the contact portions 35 of the lead terminals 25 protruding from the side surfaces before and after the reversing only have to be different from each other.

Figure 8A:
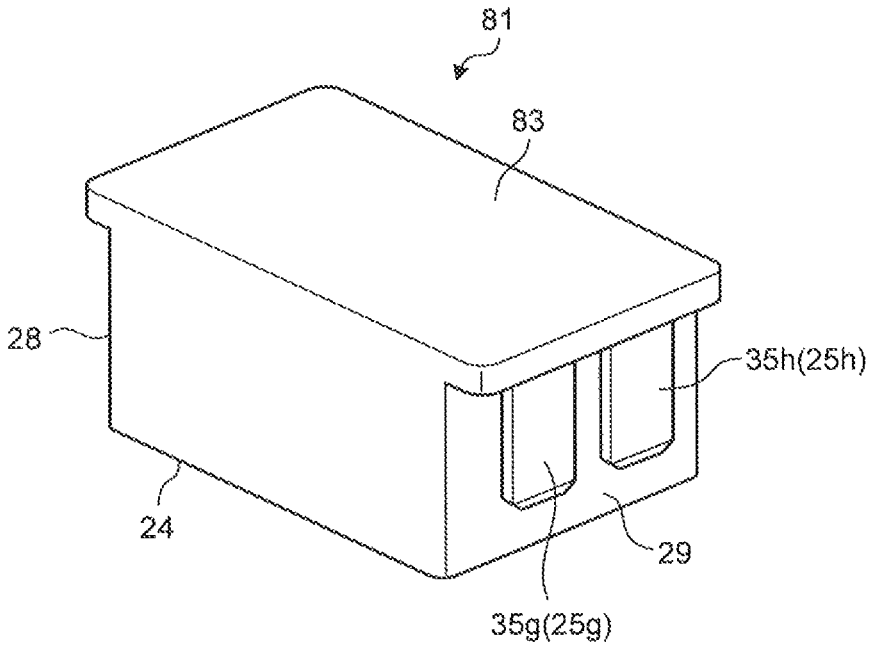
FIG. 8A is a perspective view of a relay according to another embodiment.
Figure 8B:
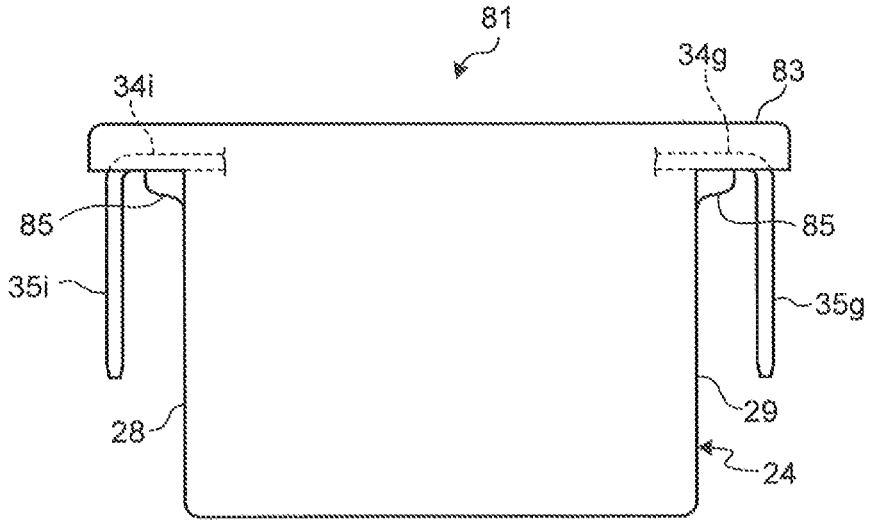
FIG. 8B is a side view of the relay illustrated in FIG. 8A.
Figure 9:
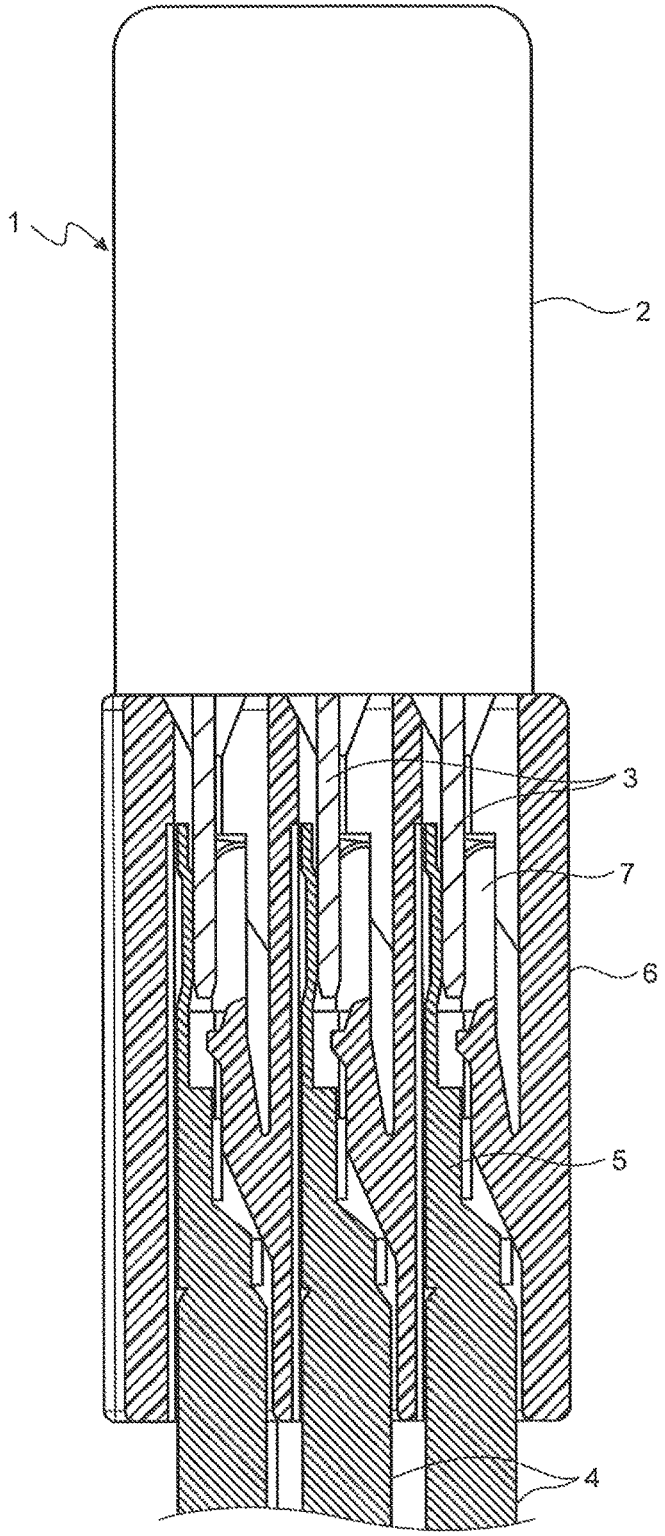
FIG. 9 is a longitudinal-sectional view of a relay module according to the related art.
Figure 10:
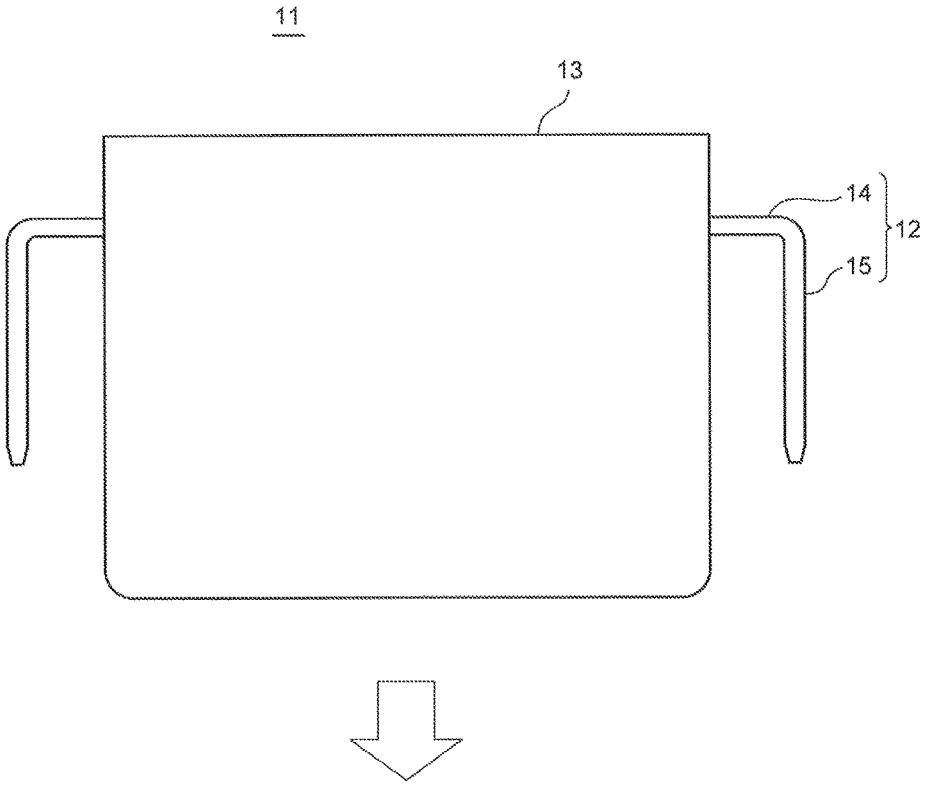
FIG. 10 is a side view illustrating an example of a relay according to the related art.

In the above-mentioned relays, the base ends 34 of the lead terminals 25 are completely exposed, but at least a part of each base end 34 may be covered with a resin. FIG. 8A is a perspective view illustrating an appearance of a relay in which the base ends 34 are covered with a resin and FIG. 8B is a side view thereof. In the relay illustrated in FIGS. 8A and 8B, same as in FIG. 7, the width in the front-back direction of two lead terminals 25 facing the left side surface 28 of the relay main body 24 is different from the width in the front-back direction of two lead terminals 25 facing the right side surface 29.

As illustrated in FIGS. 8A and 8B, a plate-like insulating member 83 is attached to a relay 81 according to this embodiment along one surface of the relay main body 24. The insulating member 83 is formed in a substantially rectangular shape in a plan view by molding an insulating resin or the like. The insulating member 83 extends in a direction perpendicular to the side surfaces 28 and 29 facing the lead terminals 25 and is formed to cover the base ends 34 of the lead terminals 25.

As illustrated in FIG. 8B, the base ends 34 are covered with the insulating member 83 in the axial direction thereof and the contact portions 35 are disposed to protrude from the bottom surface of the insulating member 83. Protrusions 85 are formed to have a stepped section at positions at which the insulating member 83 and the side surfaces 28 and 29 intersect each other. The protrusions 85 come in contact with the top end faces of the wall portions 39 when assembling the relay 81 into the housing member 23.

According to this configuration, the base ends 34 of the lead terminals 25 can be supported from the upper side by the insulating member 83. Accordingly, since a load applied to the lead terminals 25 at the time of insertion of the lead terminals 25 into the terminal fittings 22 can be greatly reduced, it is possible to prevent deformation of the lead terminals 25. As a result, it is possible to keep the electrical connection state between the lead terminals 25 and the terminal fittings 22 favorably and to prevent a decrease in the holding force of the relay 81 to the housing member 23. By covering the base ends 34 of the lead terminals 25 with the insulating member 83, it is possible to prevent short-circuit between neighboring lead terminals 25.

In the above-mentioned embodiments, the relay 21 illustrated in FIG. 1, the relay 61 illustrated in FIG. 5, the relay 71 illustrated in FIG. 7, and the relay 81 illustrated in FIGS. 8A and 8B are described as the electronic component assembly structure according to the present invention, but the configuration of the electronic component is not limited to these examples. It is possible to prevent improper assembly in which a relay is assembled into the housing member 23 with an improper arrangement, as long as an electronic component having the following configuration. That is, the electronic component includes a component main body having a rectangular parallelepiped shape (which includes a square parallelepiped shape) and plural lead terminals disposed to face a pair of opposite side surfaces of the component main body, the lead terminal includes a contact portion drooping along the corresponding side surface of the component main body. Here, when the component main body is rotated at 180 degrees to reverse the positions of the pair of opposite side surfaces of the component main body, at least one of the number of lead terminals on each side surface before and after the reversing, a distance (that is, the insertion position of the contact portion) between the contact portion and the side surface of the component main body facing the contact portion, and a width dimension in a direction perpendicular to the extending direction of the contact portion differs.

For example, the embodiments have described the relay module using a relay as an electronic component, but the electronic component is not limited to the relay. The embodiments may be applied to other electronic components as long as electronic components include a component main body and lead terminals having configurations and appearance similar to the relay main body and the lead terminals according to the embodiments. Specifically, the embodiments may be applied to, for example, a control module or a fuse in which components such as an electronic circuit board are accommodated in a resinous case.

According to the present invention, it is possible to prevent improper assembly of an electronic component.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electronic component assembly structure comprising:

an electronic component configured to include a component main body having a rectangular parallelepiped shape and a plurality of lead terminals;

a housing member in which the electronic component is inserted and accommodated; and a plurality of terminal fittings configured to be held in the housing member and to which the lead terminals are inserted and fitted, respectively, wherein each of the lead terminals includes a plate-like base end protruding from one of a pair of opposite side surfaces of the component main body and a plate-like contact portion extending from the base end and drooping along one of the opposite side surfaces of the component main body, height positions of tips of the contact portions are set to a height position above a bottom surface of the component main body, and a width dimension in a direction perpendicular to an extending direction of the contact portion of the lead terminal disposed on the first side surface is different from the width dimension of the lead terminal disposed on the second side surface, and the width dimensions of each of the lead terminals disposed on the same side surface are equal to each other, and the electronic component is inserted and accommodated in the housing member, the plurality of lead terminals come in contact with the plurality of terminal fittings, respectively, and the electronic component is assembled into the housing member.

2. An electronic component comprising:

a component main body having a rectangular parallelepiped shape; and a plurality of lead terminals configured to be disposed to face a pair of opposite side surfaces of the component main body, wherein each of the lead terminals includes a plate-like base end protruding from one of a pair of opposite side surfaces of the component main body and a plate-like contact portion extending from the base end and drooping along one of the opposite side surfaces of the component main body, the contact portions are configured to be fitted to terminal fittings held in a housing member accommodating the electric component, height positions of tips of the contact portions are set to a height position above a bottom surface of the component main body, and the number of lead terminals on each side surface of the pair of opposite side surfaces differs, a distance between the contact portion of the lead terminal disposed on a first side surface of the pair of opposite side surfaces and the first side surface differs from a distance between the contact portion of the lead terminal disposed on a second side surface of the pair of opposite side surfaces and the second side surface.

* * * * *